United States Patent [19]

Honegger

[11] Patent Number: 5,067,697

[45] Date of Patent: Nov. 26, 1991

[54] METHOD AND MEANS FOR TABLOID FURTHER PROCESSING

[75] Inventor: Werner Honegger, Tann Rüi, Switzerland

[73] Assignee: Ferag AG, Hinwil, Switzerland

[21] Appl. No.: 394,879

[22] Filed: Aug. 17, 1989

[30] Foreign Application Priority Data

Sep. 9, 1988 [CH] Switzerland ..... 338288

[51] Int. Cl.[5] ..... B41L 43/12

[52] U.S. Cl. ..... 270/37; 270/58; 270/32; 270/54; B41L/43/12

[58] Field of Search ..... 270/1.1, 52, 53, 54, 270/55, 56, 57, 58, 59, 60

[56] References Cited

U.S. PATENT DOCUMENTS

| | | | |
|---|---|---|---|
| 3,951,399 | 4/1976 | Reist | 270/58 |
| 3,982,453 | 9/1976 | D'Amato | 270/58 |
| 4,234,178 | 11/1980 | Beckert | 270/58 |
| 4,463,677 | 8/1984 | Kuehfess | 270/1.1 |
| 4,466,603 | 8/1984 | Schnell | 270/58 |
| 4,519,599 | 5/1985 | Mayer | 270/53 |
| 4,585,220 | 4/1986 | Zemke | 270/54 |
| 4,601,462 | 7/1986 | Bowman | 270/53 |
| 4,795,143 | 1/1989 | Tsai | 270/53 |
| 4,811,938 | 3/1989 | Hansch | 270/54 |

FOREIGN PATENT DOCUMENTS

| | | | |
|---|---|---|---|
| 85193/82 | 2/1983 | Australia . | |
| 8401935 | 5/1984 | PCT Int'l Appl. | 270/52 |

*Primary Examiner*—Edward K. Look
*Assistant Examiner*—Therese M. Newholm
*Attorney, Agent, or Firm*—Walter C. Farley

[57] ABSTRACT

The invention permits an inexpensive, flexible further processing of tabloids to smaller format double and multiple folds.

In at least one conveying conversion means with in each case at least one removal station (19', 19'', 19'''), preferably simultaneously several starting products are removed, which are then further processed in parallel as clusters. The clusters are jointly conveyed by conveying means (36–46, 50, 51) and in each case all the printing products of a cluster (2) are simultaneously processed.

The method and means have a fundamentally upwardly open processing capacity, even in the case of large printing products.

19 Claims, 8 Drawing Sheets

41
41'
46
40
36
B
4
51'
52
55
E
51
54
53
50
D
51
54
54
54
51
4
50

METHOD AND MEANS FOR TABLOID FURTHER PROCESSING

The invention is in the field of printworks technology and relates to a method and apparatus for changing a serial stream of tabloids or the like into parallel streams for parallel processing.

BACKGROUND OF THE INVENTION

In printworks, particularly in the newspaper field, the printing products obtained from the rotary press are frequently converted into the form of tabloids, i.e. single or multiply folded printed sheets and are in this way supplied to further processing stages. The equipment set up for such operations are therefore specially adapted to the processing formats. In newspaper production this means that relatively large format tabloids with dimensions of e.g. 30×50 cm are located in the means following the press. Subsequently such tabloids are further processed into double or treble-folds.

Of late there has been an increasing need for using the rotary press and the means following it for a broader spectrum of printworks products. This is inter alia due to the fact that modern rotary presses, apart from multicolour printing, permit high quality offset printing and can therefore be increasingly used for brochures, magazines and other products. It is simultaneously possible within the offset printing process to quickly produce printing plates and therefore ensure that the printing products are very up-to-date. In view of the relatively high costs for the press and conveying systems, there is a need for a maximum utilization of the system, i.e. in the field of newspaper production this should occur on a daily basis. However, possibilities are limited by the means following the press, because they cannot be used for the further processing of the tabloids conventionally occurring with offset printing or possibly double-folds to relatively small size brochures and the like. A further problem is that an additional fold on the tabloid or on the double fold leads to unattractive creases on the bundle, which cannot be eliminated even following the final processing or the cutting up of a fold. This disadvantage generally leads to unacceptable deformations on folding a tabloid. Such quality losses are highly undesired. In addition, the final processing of the tabloids to a small or medium format magazine end product additionally requires in part relatively slow working steps, so that conveying and processing plants existing with conventional methods must have a complicated construction so as not to become overtaxed regarding the processing capacity e.g. in a timed operation.

If the tabloid processing speed is to reach 40000 to 50000 copies per hour, in the case of conventional plants fundamental problems occur. Attempts have been made to cope with such speeds in high capacity plants. However, this leads to a rapid increase in plant costs and in part physical processing limits are encountered.

SUMMARY OF THE INVENTION

An object of the present invention is therefore to provide a method and apparatus to it possible, in a relatively limited space to permit further processing of tabloids and subsequent final processing which have a high and in principle unlimited processing capacity and which can be readily integrated into an overall system, while having no disadvantageous effect on the processing speeds of upstream and downstream processing equipment plants.

The invention is also directed at providing a method and a means permitting the further processing of tabloids without any buffer means directly from the rotary press, which can be extended simply and inexpensively with regards to the processing capacity.

A method of conveying and processing tabloids and other folded printed products in a processing system comprising the steps of delivering a serial sequence of folded printed products to a conversion station, extracting at the conversion station a plurality of starting products from the sequence and forming a cluster including the extracted products, each cluster including at least two printed products, conveying the cluster away from the conversion station, repeating the steps of extracting, forming and conveying the clusters to thereby create a plurality of streams of products being conveyed in parallel, conveying the stream of clusters of products to a processing location, and processing the products while they are in the clusters.

The tabloid processing speeds attainable by means of the invention make it possible to make additional folds, e.g. also in the final working stage. This makes it possible to fold the tabloid in an already cut up state and avoid unattractive deformations.

BRIEF DESCRIPTION OF THE DRAWINGS

The invention is described in greater detail hereinafter relative to non-limitative embodiments and the attached drawings, wherein.

DESCRIPTION OF THE PREFERRED EMBODIMENTS

The term "end product" is here understood to mean printworks products, such as exist after performing the inventive method, i.e. at the outlet from a processing plant and at the outlet in general, a state suitable for despatch is reached. The term "starting product" refers to all printed products, such as are supplied to a means according to the invention to be converted into end products, i.e. in general tabloids. For example, also double-folds or multi-folds can be supplied as starting products. It is generally then necessary to accept the fact that the aforementioned deformations will occur on the bundle or the second fold. Obviously, end products as covered by the aforementioned definition can be supplied to further working stages.

If from a conventional rotary press tabloids are supplied at a specific speed v to subsequent apparatus for further processing steps, this means that, fundamentally, processing must take place at the same speed v. The sought end products generally have a relatively large size of e.g. 300 pages. Particularly in the case of such large end products, this further processing in part requires relatively slow working stages, so that the necessary processing capacity cannot be reached. As a result of complicated measures it is possible to increase the capacity to a certain extent. Thus, e.g. a buffer system can be provided following the rotary press, or the product stream can be subdivided into several individual streams. However, these measures require relatively high costs and lead to comprehensive adaptations of the overall plant.

In accordance with one of the objects of the invention of achieving an upwardly unlimited processing capacity, a novel processing and conveying concept is used. Unlike in the case of conventional plants using serial conveying, e.g. as a scale or stream flow, while the individual printed products are also processed in a serial manner, the products are conveyed and processed in groups as clusters. Such a conveying principle is described in copending U.S. patent application Ser. No. 394,880 filed Aug. 17, 1989 and for additional details reference is made to the disclosure therein. Thus, the advantages of serial conveying can be fundamentally retained, but the processing capacity considerably increased. The large processing capacity makes it possible to fold the tabloids to smaller formats during the final working stages, particularly after cutting up the same and therefore in this way to economically produce the small format printed products by offset printing. It must be borne in mind that the method according to the invention simultaneously solves the problem of widely differing processing capacities of the individual system components.

Figure 1:
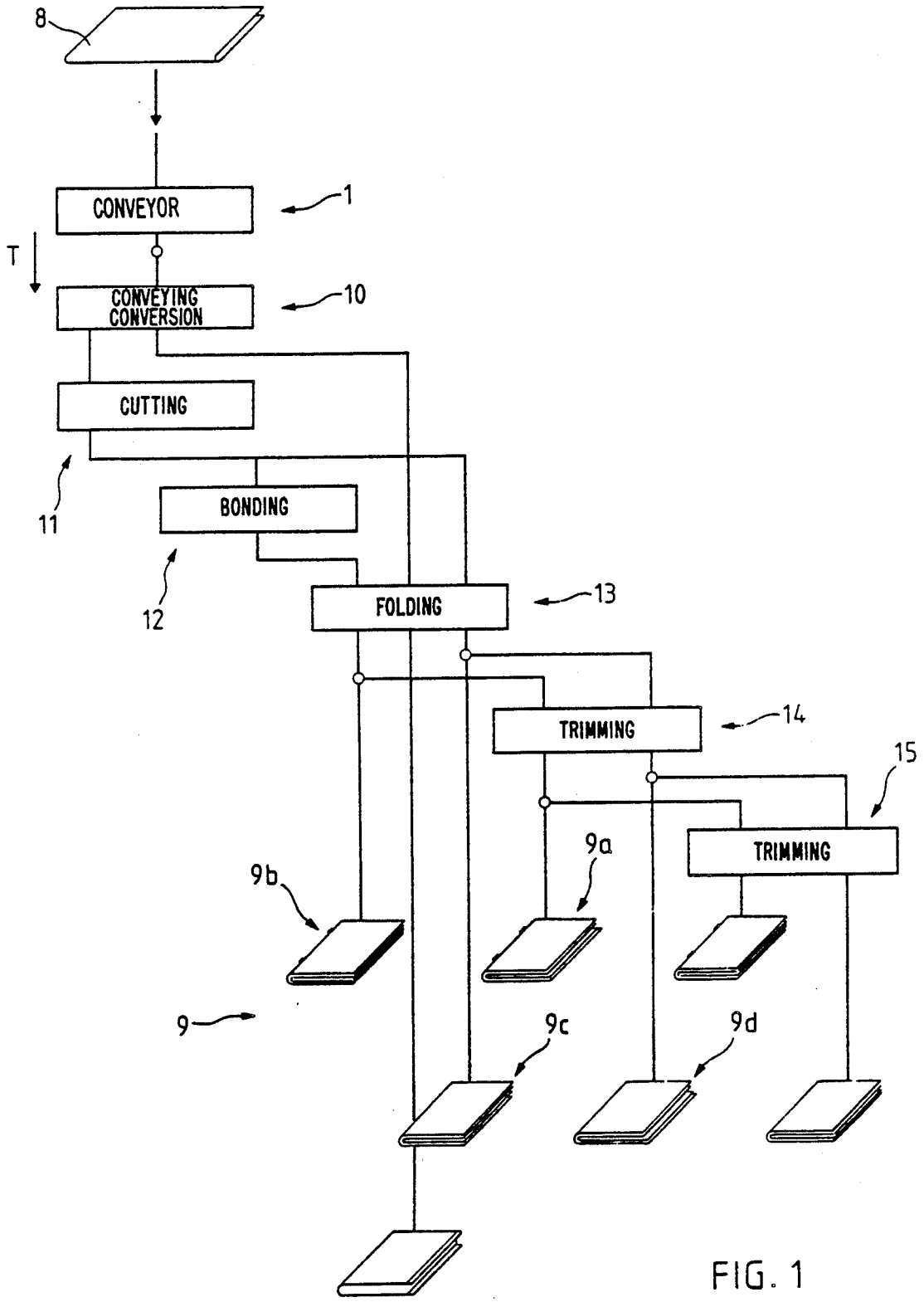
FIG. 1 is a block diagram illustrating the steps and principles of the inventive method.

FIG. 1 shows the fundamental sequence of the inventive method. It must be stressed that important inventive elements have been omitted from this overview so as not to make it confusing. The process within and immediately following the printing process is not shown and it is assumed that the starting products 8, in this case tabloids, are conveyed with conveying means or in a conveyor 1 with a specific clock cycle T. The starting products 8 can be converted by means of the inventive method into the formats of the end products 9 referred to in the drawing. These formats are possible because the method permits a cutting up 11, bonding 12, folding 13 and two or three-page trimming 14, 15. The important element of the method is the conveying conversion 10, to which further reference will be made relative to FIG. 2. By a suitable combination of these processing stages it is e.g. possible to compile ½ format, bonded and trimmed or untrimmed end products 9*a* or 9*b*, ½ format, unbonded and trimmed or untrimmed end products 9*d* or 9*c*.

Figure 2:
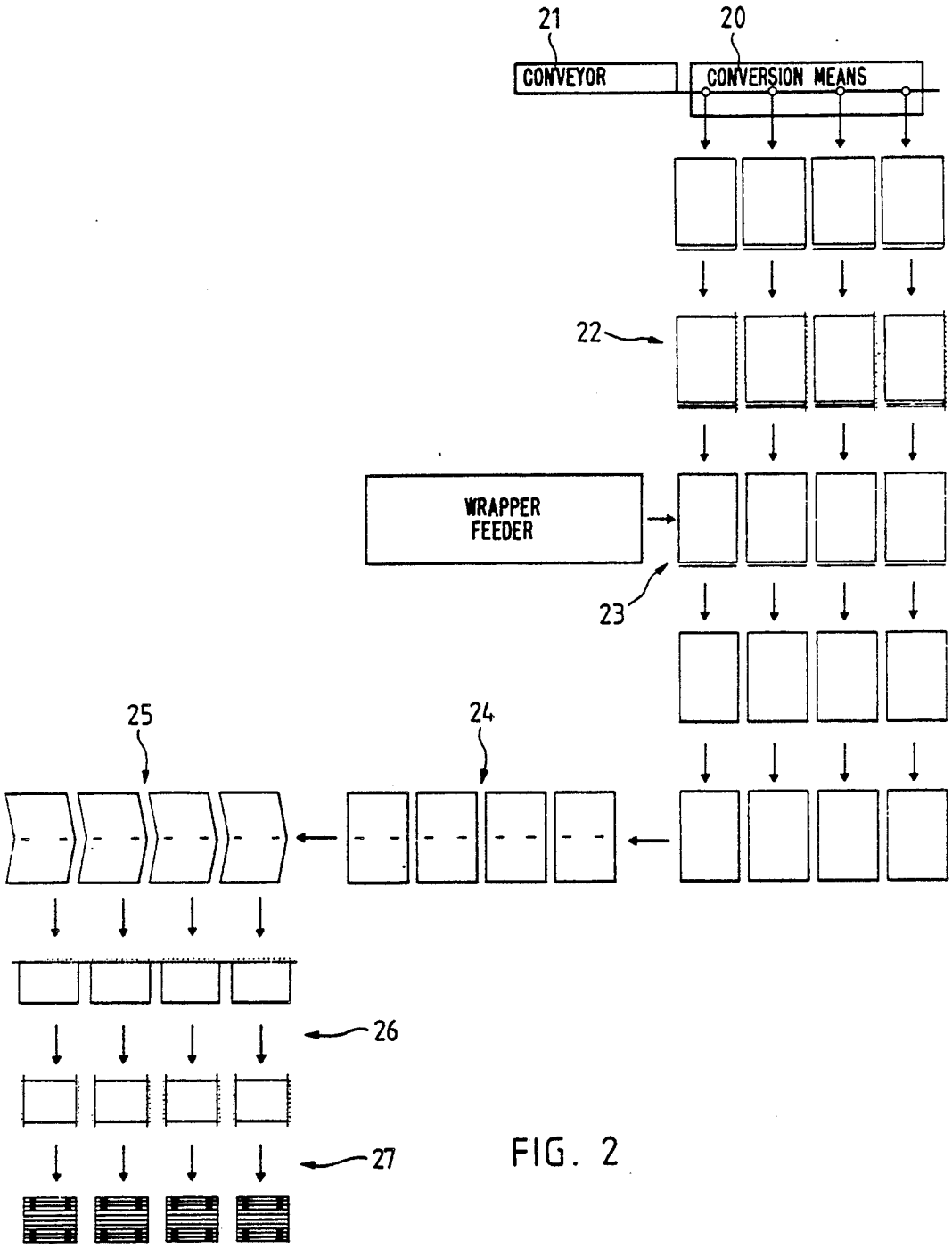
FIG. 2 is a flow diagram showing conversion of the printing products from serial flow into clusters.

FIG. 2 represents in greater detail an example of the conveying conversion. The starting products are supplied continuously and in preferably timed manner via a conveying means, in this case a timed conveyor 21 to a conveying conversion means 20. The latter is used for converting the starting products, here supplied in a conventional serial manner, into printed product clusters. The term printed product cluster means a group of at least two individual printed products, which are processed in parallel over at least a partial segment or process. It must be stressed that parallel processing means a functional parallelism, i.e. the individual printed products of such a cluster undergo simultaneously identical or functionally associated working steps. The relative arrangement of the printed products in a cluster can vary. Preferably the printed products are juxtaposed and parallel to one another in one plane. Thus, the processing of the printed products of a cluster takes place as a function of the working clock T'. This is contrasted with the partial subdivision of a conveying segment into two or more parallel webs used in printworks conveying technology, in which there may be a geometrical parallel guidance, but this is merely for reducing the conveying speed of the supply segment. In the case of such methods no significance is attached to the simultaneous processing of a cluster, i.e., there is no processing relationship between the elements of a functionally associated unit of printed products. A distinction must also be made between this further processing and methods bringing together several printed products, e.g. an insertion process, in order to subsequently convey or process the same jointly as a unit. In the method according to the invention each individual product is admittedly processed in a cluster, but each individual starting product is always processed in functional association with the other printed products of the cluster. The function of this conveying conversion means 20 can be looked upon as a conversion of an e.g. timed and serially conveyed stream flow into a cluster flow conveyed with a different timing.

As is apparent from FIG. 2, the aforementioned working steps, e.g. cutting up of the printed products, are in each case performed simultaneously on the entire cluster, i.e. there is a parallel processing of the products contained in a cluster. For carrying out the individual working steps, it is possible to use conventional work stations, provided that they are able to simultaneously process the printed products of an entire cluster. It is obviously also possible to use for a working step a number of work stations corresponding to the number of printed products per cluster. In the present case (FIG. 2) four printed products are in each case jointly processed in a work station. It is obvious that the size of the cluster can vary as a function of the use. The size of a cluster is preferably also chosen as a function of the timing or conveying speed T' desired for the cluster processing. If relatively slow processing steps are to be performed for processing the tabloids following the conversion means, the timing clock T' can be increased, or the conveying speed of the printed product cluster decreased, so that the following steps can be performed at the necessary speed. It is a major advantage of the inventive method that the individual working steps, as a function of the choice of the cluster size, can take place relatively slowly. Thus, it is possible in very fast overall processes to use a larger number of inexpensive, slowly operating components. It is also possible to largely avoid interface problems, such as occur with different processing speeds of the individual components. As can be gathered from FIG. 2, the starting products, after conversion into clusters of four, are passed through a device 22 for cutting up the tabloids, then through a cover or wrapper feeder 23, a bonding device 24, a folding device 25 and finally a page trimming device 26. It is obvious that the working steps can take place in a variable order, or can be suppressed or omitted, so that as a function of the chosen requirement different types of end products can be packeted and despatched at outlet 27. In addition, further functions can be provided, or the end products can be supplied to a further conveying means permitting a subsequent, remote operating process. It is also possible within the processing plant to bring together or combine several partial printed products (e.g. several starting products), so as to obtain end products with a large number of pages.

It is clear that the bonding takes place following a 90° turn of the printed products. Although this is here, from the purely geometrical standpoint, a linear and therefore, at a first glance, apparently serial processing, in fact there is a parallel processing of four printed products combined into a cluster. Such a deflection or turn is e.g. necessary or desired if a processing means, in this case e.g. bonding device 24 requires this for better accessibility. However, there is fundamentally a processing with clock T', which fundamentally applies for the complete processing path shown here. The nature of the printed product conveying and the deflection by 90° will be described relative to FIG. 5.

Figure 3:
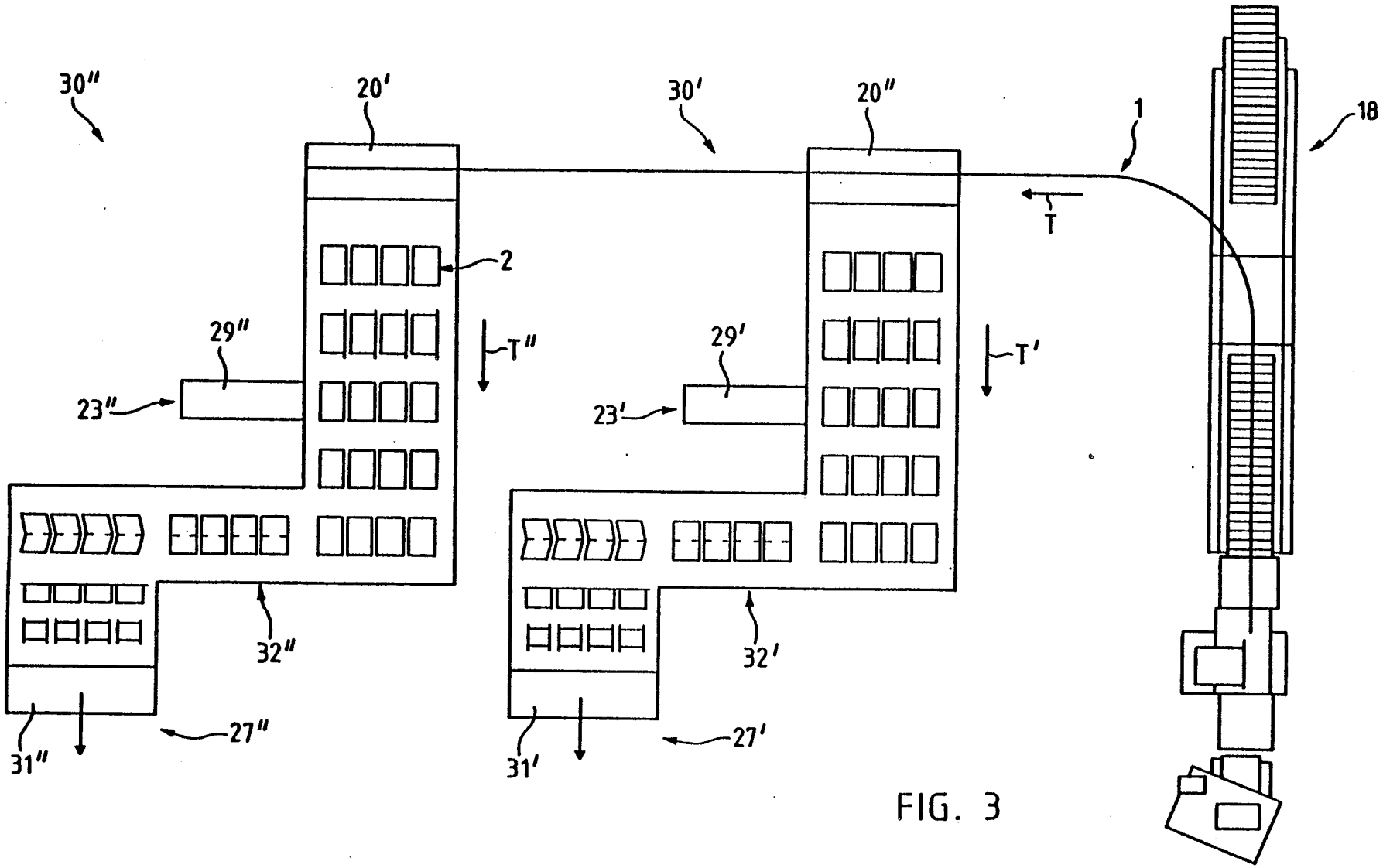
FIG. 3 is a schematic block diagram of one embodiment of an apparatus for performing the method in accordance with the invention.

FIG. 3 diagrammatically shows an embodiment of the means according to the invention. From a buffer means 18, e.g. like that described in U.S. patent application Ser. No. 07/288,942, Meier, or a feeder, starting products are supplied via a conveyor 1 to two processing systems 30', 30''. Although the means has been illustrated by means of a plant with a timed supply, the printed products can obviously also be continuously conveyed by means of other conveying devices and are only individually gripped for converting into printed product clusters and conversion into a timed processing configuration. The conveying clock of the printed products is designated T. The printed products are supplied to conveying conversion means 20' and 20''. In this embodiment, printed products are taken at two different points from a linear supply in that individual starting products are removed, for example, by a gripper. This process will be explained in greater detail relative to FIGS. **4*a* and 4*b*. It is obviously possible in conventional manner by means of a sorting gate to bring about a subdivision of the supply into two conveying segments, the latter in each case supplying a conversion means 20', 20''. The individual printed product clusters 2, e.g. here shown with four printed products, are shown in their different conveying or processing positions. With the exception of two wrapper feeders 23', 23'', the individual processing possibilities are not described in detail and reference can be made in this connection to FIG. 2. There are two supply means 29', 29'', which supply the wrapper feeders with wrappers. In the same way, but via additional supply means, further partial products can be supplied and brought together or combined with the printed products of the clusters in a random way. It is therefore possible to bring together complete printed product clusters, i.e. several printed products simultaneously, which leads to very high working capacities. The clusters are conveyed and/or processed with a clock T' or T'' within the processing plants 30', 30''. Often clocks T' and T'' are identical. However, if the processing plants 30', 30'' do not perform identical working steps, it may be desirable to convey the clusters within the two plants with different clock cycles. At the two outlets 27' and 27'', there can be means 31', 31'' for the conversion of the clusters. Restoration to serial conveying is made possible in this way. The cluster-based processing of the printed products with a clock T' or T'' makes it possible to e.g. bring about a simple return of the flow to the original clock T. Thus, a processing plant 30' or 30''** requiring relatively slow working steps, such as e.g. the bonding of large printed products, can easily be integrated into an overall sequence.

The inventive method is particularly suitable in an overall system with a system clock T. It is then possible to link the cluster clock T' or T'' with the system clock T. By a central control means, it is possible in a simple manner to control the conveying conversion means and to convert the serial into a parallel, groupwise processing, or the clusters can be converted back into serial conveying or processing with separated printed products or a stream or scale flow. It is e.g. readily possible to carry out buffering in this way.

The modification or deflection of the conveying direction by 90° within the processing plants 30', 30'' (FIG. 3), mentioned in connection with FIG. 2 does not alter the clock cycle. Within each clock cycle, each cluster is passed on by one working or conveying unit. If the processing plant contains a very slow process, then for this working step one printed product cluster can remain there for more than one clock cycle. It is necessary for this purpose for the ratio of the clock frequency T' or T'' to the system clock to be so large that the processing plant permits buffering. For this purpose clock T' or T'' in the processing plant is chosen in such a way that T' divided by T is smaller than the number of printed products per cluster. If the clock in the processing plant is precisely as large as the ratio of the supply clock multiplied by the number of printed products per cluster, then the supply and processing plant have identical conveying capacities.

FIG. **4*a* now shows the conversion of starting products serially conveyed by means of a clock conveyor into clusters of in each case three printed products. In this embodiment every third copy is removed at three different removal stations 19', 19'', 19'''**. As is apparent from the drawing, in each of these removal stations in each case three starting products are removed and conveyed on or processed in juxtaposed manner as common clusters. Although the individual printed products have been shown in differently hatched manner for ease of understanding, the serially supplied starting products are identical. Preferably the removed printed products are arranged in juxtaposed, parallel manner within a cluster. It is readily possible by using conventional sorting gates to bring together on a common conveying segment the printed products combined to clusters in the individual removal stations and in this way to obtain a single cluster flow.

FIG. **4*b* shows another example of a conveying conversion means, which converts the serial stream flow 3 into clusters of four starting products. At a first removal station 19', every second and, in all, four printed products are removed. The same removal process takes place at the second removal station 19''**.

Figure 4A:
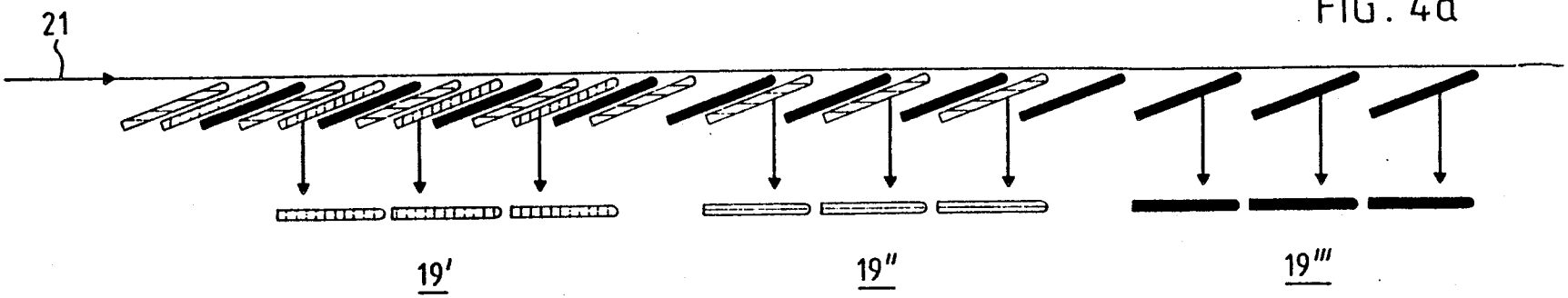
FIG. 4*a* is a simplified flow diagram showing the removal of printing products for forming clusters with, in each case, three printed products.
Figure 4B:
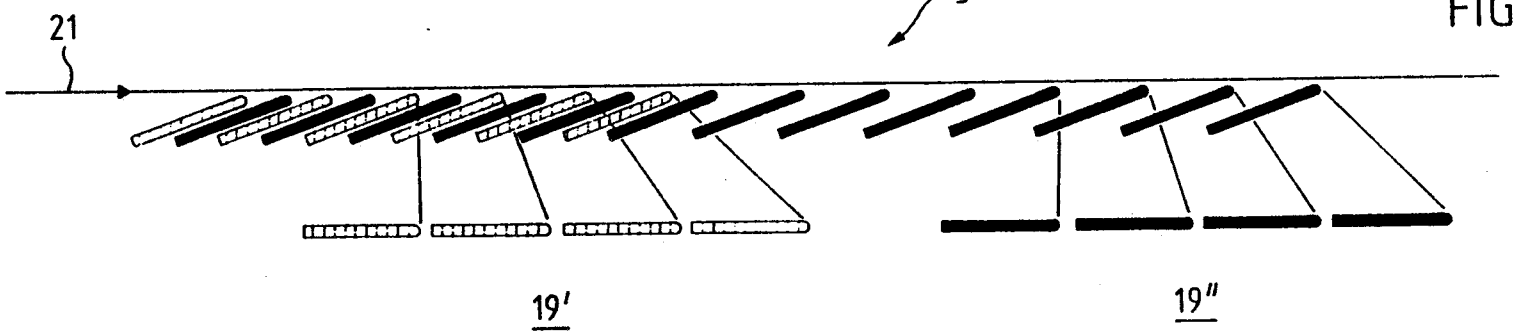
FIG. 4*b* is a diagram similar to FIG. 4*a* showing the manner of extracting products for forming clusters of four.

The removal of the individual starting products at the removal stations e.g. takes place with a gripper according to U.S. Pat. No. 4,779,717, Eberle, or a means according to Swiss patent applications of the same Applicant No. 415/87 filed on 23.10.1987 and 3319/87 28.8.1987 (U.S. Pat. No. 4,893,805). As can be gathered from FIG. 4*b*, matched to the conveying clock and following individualization, at the individual removal station either simultaneously and using four grippers, a complete cluster is produced, or by means of a single gripper successively four starting products are removed.

The processing plants 30', 30'' or their conveying means 36–46, 50, 51 (FIG. 5) are preferably arranged at right angles to the conveying means 1, so that in simple manner it is possible to arrange in juxtaposed manner several processing plants or conveying conversion means 20', 20''. Although usually preference is given to a reciprocal right-angled arrangement of the processing plants and conveying means 1, the conveying means 36–46, 50, 51 can be at any desired angle to the conveying means 1.

For specific working stages within the processing plant 30', 30'', it may be desirable to deflect the conveying means 36–46 by 90° or selectable other angle. As can be gathered from FIG. 3, in this embodiment the conveying of the clusters on at least a portion 32', 32'' takes place at right angles to the original conveying direction following conversion means 20', 20''. Such a deflection of the conveying direction of the clusters is e.g. necessary if this is required for accessibility purposes in a processing means.

Figure 5:
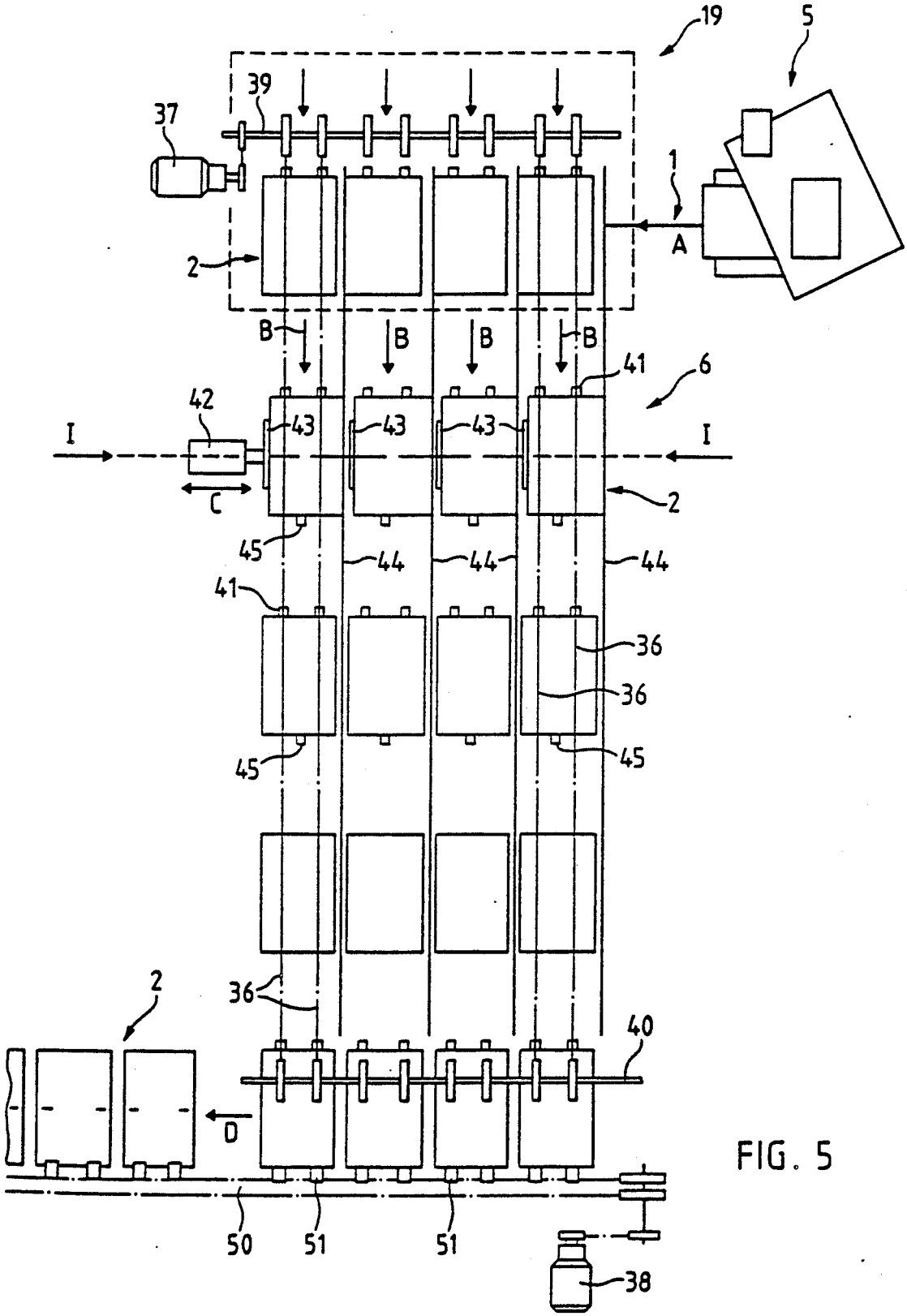
FIG. 5 is a schematic illustration of the arrangement of apparatus for conveying clusters in a processing plant.

FIG. 5 diagrammatically shows an embodiment for conveying printed product clusters 2 each including four printing products. By means of a feeder 5 diagrammatically shown therein the last supplied printed products are separated or individualized. It must be borne in mind that feeder 5 is shown on a smaller scale for ease of viewing reasons. The printed products are supplied thereto by means of a not shown conveying means, e.g. a clamp conveyor. Such a feeder 5 and the nature of the separation can be of a conventional type. The thus separated printed products are supplied by a conveying means 1, e.g. also a clamp conveyor, in the direction of arrow A to a removal station 19. In this embodiment the clusters 2 brought together by means of the removal station 19 are supplied to the working stations following the removal station by several chain strands 36, which are indicated by dot-dash lines.

A common driveshaft 39 is driven by means of a first motor 37. The revolving chain strands 36 are guided via guide wheels of the driveshaft and a second shaft 40. These chain strands 36 are not driven continuously and instead this takes place with a clock T'. At regular intervals on the chain strands 36 are provided conveying cams 41 (only two of these are shown in the drawing). As can be gathered from the drawing, for conveying a cluster with in each case four printed products, eight such chain strands 36 are provided. Each individual printed product is conveyed in the direction of arrow B by in each case two conveying cams 41. As the chain strands 36 in this embodiment are jointly driven, the printed products are necessarily synchronously conveyed. The printed products are preferably located on conveying plates, which can be designed in a conventional manner. The conveying cams 41 ensure the parallel orientation of the printed products in the conveying direction. The relative lateral orientation of the printed products is diagrammatically shown for a first working station 6. By means of a lift cylinder 42, vertical guide plates 43 are reciprocated at right angles to the conveying direction in the direction of arrow C. Thus, the individual printed products of a cluster are moved against guide rails or plates 44 and therefore laterally correctly positioned. Simultaneously and in the individual working stations are provided counter cams 45 for positioning the clusters in the conveying direction. The timed conveying and processing of the clusters makes it possible that the individual printed products of a cluster are in each case precisely oriented in the individual working stations.

The deflection by 90° is achieved in this embodiment by transfer to a revolving gripper chain 50, e.g. according to German patent 2151583. Through e.g. eight grippers 51, in each case two per printed product, the printed products of a cluster are synchronously gripped. The gripper chain 50 is driven by means of a second motor 38. The clusters are conveyed in the direction of arrow D by said gripper chain.

Figures 6A, 6B:
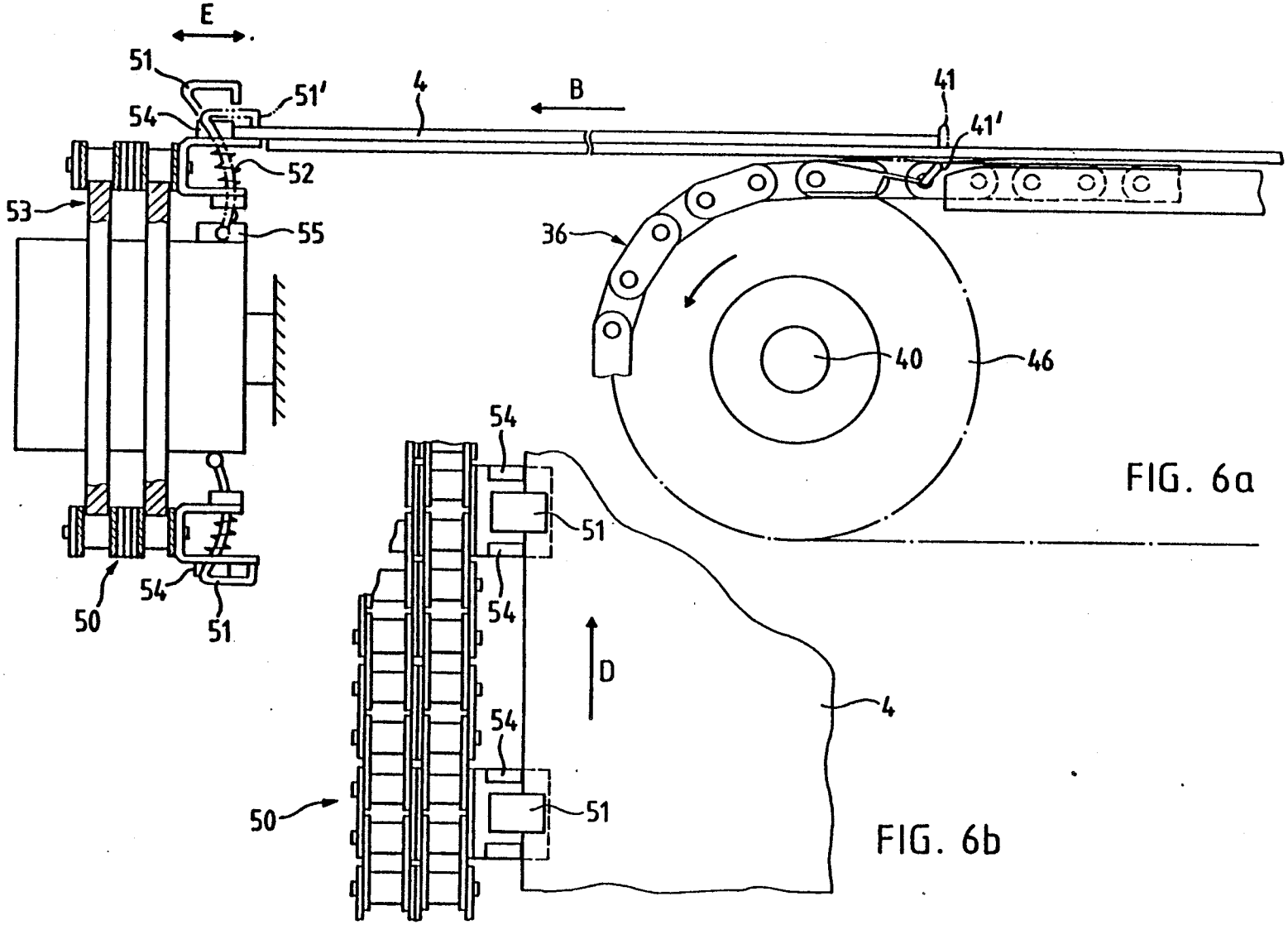
FIG. 6*a* is a side elevation in partial section of a chain strand and the gripper chain at the transfer point.
FIG. 6*b* is a partial top plan view of the gripper chain with two grippers.

FIGS. 6*a* and 6*b* illustrate the transfer of the clusters from the conveying chain strands 36 to the gripper chain 50. In this side view, it is possible to see a conveying chain 36 with an associated guide wheel 46 on shaft 40. An individual conveying cam 41, 41' is shown in two positions. During conveying the conveying cam is located in position 41. By means of a control link, the cam is pivoted on transfer into transfer position 41'. In the vicinity of the transfer station, the gripper chain is preferably guided over a chain guide 53. The grippers 51 of gripper chain 50 are located in an opened standby position for receiving in each case one cluster. As soon as a cluster is inserted into a corresponding gripper 51, a closing device is operated. This can e.g. be a control link 55 operated by a light barrier, which brings the gripper held in the standby position by the bias of a spring 52 into the closed position 51'. Preferably the grippers 51 have stops 54 against which the printing products engage on transfer. As can be gathered from the drawing the grippers 51 have a certain spring displacement in the direction of arrow E, so that small linear movements of the cluster in the conveying direction can be absorbed on transfer. FIG. 6*b* shows two grippers 51 and stops 54 with a gripped printing product in a view from above. The conveying direction is indicated by arrow D. The transfer of the printed products 4 is preferably monitored and controlled by a photocell.

Figure 7A:
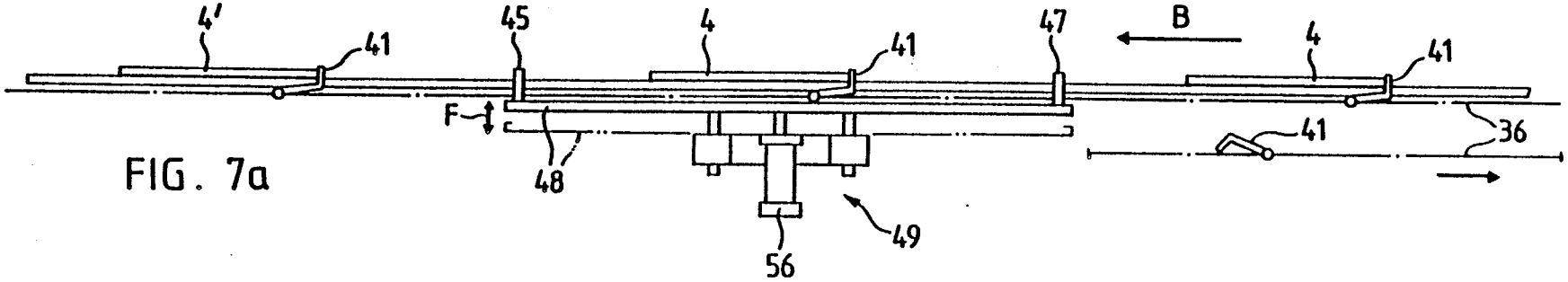
FIGS. 7*a*–7*c* are schematic side elevations showing the positioning of the printing products within a working station at different stages.
Figure 7B:
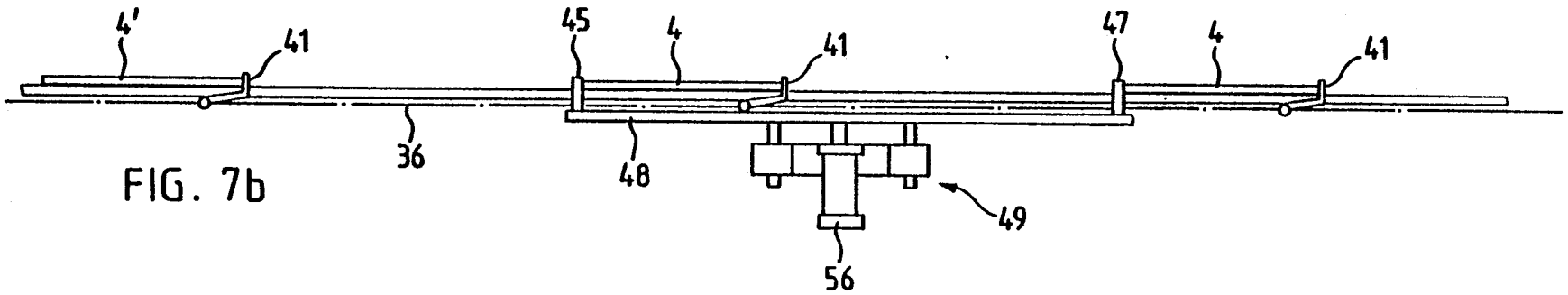
Figure 7C:
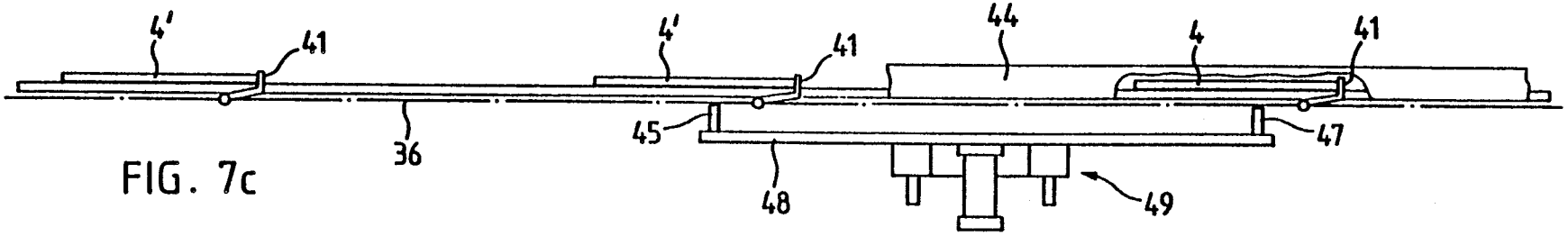

FIGS. 7*a* to 7*c* show the positions of the printed products at a work station at different stages. It is possible to see a positioning device 49 movable vertically in the direction of arrow F, a diagrammatically represented, revolving chain strand 36 with several conveying cams 41 and in the represented area there are three printing products 4, 4' conveyed in the direction of arrow B by the conveying cams 41. The positioning device 49 has at least one countercam 45 and/or a prepositioning cam 47. The prepositioning cam and countercam fundamentally fulfil the same function and generally have an identical construction. The countercams of a working station can also simultaneously take over the function of the prepositioning cams of the following station or can be identical thereto. The countercams and prepositioning cams are fixed to a commonplate 48 and are brought by means of a common adjusting cylinder 56 either into the positioning position (FIG. 7*a*, continuous line) or into the conveying position (broken line). FIG. 7*b* shows two printed products 4, which on the one hand strike against countercam 45 and on the other against prepositioning cam 47. Therefore the printed products are oriented before they are guided into the actual working station, which allow rapid clock cycles in timed operation. Therefore these two printed products are correctly positioned or prepositioned for processing in the conveying direction. The printed product 4' processed in this working station, which can fulfil any chosen function, such as e.g. cutting up, is conveyed onto the left into a further working station. FIG. 7c shows the printed products in the conveying phase. It is possible to see a guide rail 44, which serves as a guide for the printed products 4, 4'.

Figure 8:
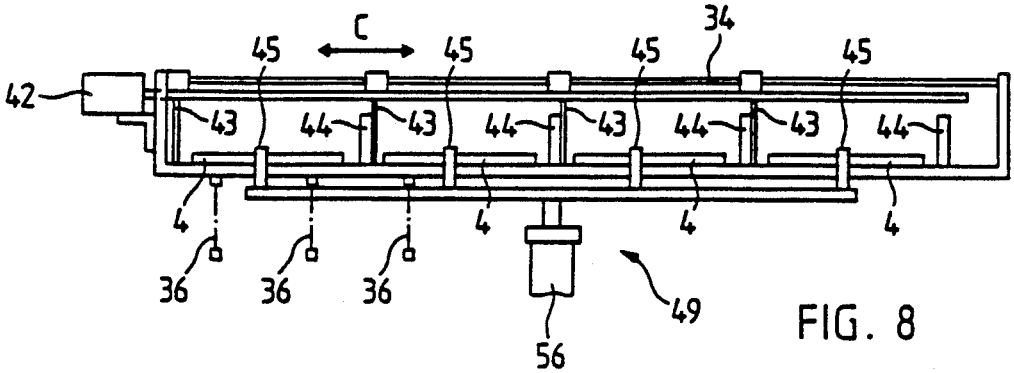
FIG. 8 is a transverse sectional view through the processing plant along section line I—I in FIG. 5.

For illustrating this lateral orientation, FIG. 8 shows a section through the positioning device 49 at right angles to the conveying direction. Only three chain strands 36 are shown in this drawing. A cluster with printed products 4 is conveyed forwards at right angles to the drawing plane and strikes against in each case one countercam 45. By means of a lift cylinder 42, four guide plates 43 coupled by one or more carriers 34 can be reciprocated at right angles to the conveying direction towards arrow C for the side direction of printed products 4. Printed products 4 are moved against guide rails 44 and are then precisely oriented with respect thereto for processing both in the conveying direction and at right angles thereto.

Figure 9:
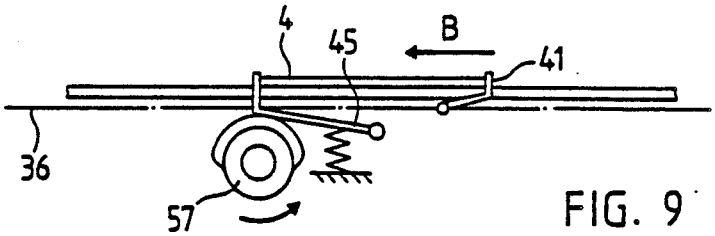
FIG. 9 is a partial side elevation of one embodiment of an actuator for the countercams for positioning the printing products.

FIG. 9 shows another embodiment for the actuation of countercam 45. By means of an eccentric 57 countercam 45 is brought into the positioning or conveying position as a function of the conveying clock. At the represented time the countercam 45 is at the top, i.e. in the positioning position and serves to orient a printed product 4 in conveying direction B.

The invention is preferably used in the offset printing field, but can also be used for intaglio printing processes and other printing processes.

Another embodiment of the invention provides for the conveying conversion means to receive starting products from several feeders and combine same into clusters. Thus, it is e.g. possible to form clusters from several feed paths or belts. In this way, e.g. it is possible to combine clusters from starting products from two or more rotary presses or winding stations. For this purpose the removal means has a number of grippers corresponding to the number of conveying plants 1, so that simultaneously it is possible to take a starting product from in each case one conveying plant and which are then combined to form a cluster.

It is obviously unnecessary for conveying to take place by a revolving chain strand or a gripper chain and instead various other conveying means can be used. For a timed supply of the clusters into the individual work stations, generally drag chain drives and in particular also a link chain are suitable, as described in U.S. Pat. No. 3,757,514. For specific uses, the processing of the clusters can also take place in untimed manner, i.e. in a continuous way.

I claim:

1. A method of conveying and processing tabloids and other folded printed products in a processing system which includes a plurality of spaced conversion stations, the method comprising the steps of delivering a serial sequence of folded printed products to a conversion station, at the conversion stations, extracting a plurality of starting products from spaced stations along the sequence and combining the products to form clusters including the extracted products, each cluster including at least two printed products, the step of extracting further including removing the products from the sequence with a gripper for forming each cluster, conveying the clusters away from the conversion stations, repeating the step of extracting, forming and conveying the clusters to thereby create a plurality of streams of products being conveyed in parallel, conveying the streams of clusters of products to a processing location, and processing the products while they are in the clusters.

2. A method according to claim 1 wherein the step of delivering includes conveying the sequence of products to the conversion station on a single conveyor.

3. A method according to claim 1 wherein the step of delivering includes conveying the sequence of products to the conversion station on a plurality of conveyors.

4. A method according to claim 1 wherein the step of extracting includes simultaneously removing the plurality of products from the sequence with a plurality of grippers for forming each cluster.

5. A method according to claim 1 wherein products are removed at a selected number n of stations to form clusters each having n products therein.

6. A method according to claim 1 wherein products are removed from the sequence at a plurality m of locations to form clusters each having n products therein, each mth product being removed until a total of n products are successively removed.

7. A method according to claim 6 wherein clusters are formed at each station and are merged to form a single cluster stream.

8. A method according to claim 1 wherein the system includes a plurality of processing stations to which the clusters are conveyed and wherein, at each processing station, all of the products in each cluster simultaneously undergo identical working steps.

9. A method according to claim 1 wherein the printing products within a cluster are oriented in parallel with each other in a single plain.

10. A method of conveying and processing tabloids and other folded printed products in a processing system of the type including a plurality of processing stations comprising the steps of delivering a serial sequence of folded printed products to a conversion station, at the conversion station, extracting a plurality of starting products from the sequence and forming a cluster including the extracted products, each cluster including at least two printed products, conveying the cluster away from the conversion station, repeating the step of extracting, forming and conveying the clusters to thereby create a plurality of streams of products being conveyed in parallel, conveying the stream of clusters of products to a processing location, processing the products while they are in the clusters, and returning the products from the clusters to serial conveying.

11. A method of conveying and processing tabloids and other folded printed products in a processing system comprising the steps of delivering a serial sequence of folded printed products to a conversion station at a system clock rate T, at the conversion station, extracting a plurality of starting products from the sequence and forming a cluster including the extracted products, each cluster including at least two printed products, conveying the cluster away from the conversion station, repeating the step of extracting, forming and conveying the clusters to thereby create a plurality of streams of products being conveyed in parallel at a cluster clock rate T' wherein the cluster clock rate T' is equal to or smaller than the system clock rate T multiplied by the number of products per cluster, conveying the stream of clusters of products to a processing location, and processing the products while they are in the clusters.

12. An apparatus for handling and processing tabloids and other folded printed products comprising the combination of first conveying means for supplying starting printed products in a serial stream;

at least two conversion means arranged successively along said first conveying means, each said conversion means including means for extracting selected ones of said starting products and combining the extracted products to form printed product clusters, each said cluster including at least two printed products;

second conveying means for conveying a stream of said clusters from said conversion means; and means for processing the products in each cluster as a group.

13. An apparatus according to claim 12 wherein said means for processing includes means for cutting, means for bonding, means for folding and means for page trimming.

14. An apparatus according to claim 12 and further comprising means for converting said clusters back into serial flow.

15. An apparatus according to claim 12 wherein said means for processing includes a plurality of work stations and said second conveying means conveys said stream of clusters to said work stations in sequence, each said work station including a positioning device for positioning pages in each printed product and for positioning each product of a cluster in the conveying direction, said apparatus further including a prepositioning device upstream of each said work station.

16. An apparatus according to claim 12 wherein said first and second conveying means are substantially perpendicular to each other.

17. An apparatus according to claim 16 wherein said second conveying means includes a change of direction of product flow of substantially 90°.

18. An apparatus according to claim 17 wherein said second conveying means at said change of direction of product flow includes a first plurality of substantially parallel endless gripper chains having grippers thereon delivering parallel clusters of products to a location at said change of direction;

a single gripper chain extending perpendicular to and across said first plurality of chains, said single gripper chain having a plurality of groups of grippers thereon at spacings substantially equal to the spacing between said parallel gripper chains so that said single chain can be moved to a position in which a group of grippers thereon is adjacent to and spaced like said parallel chains so that a cluster of products can be transferred from either the grippers on said parallel chains to a group of grippers on said single chain or from said single chain to said parallel chains.

19. An apparatus according to claim 12 and further comprising a plurality of first conveying means concurrently supplying products to one conversion means, said conversion means having a plurality of grippers equal in number to the number of first conveying means for simultaneous removal of one starting product from each first conveying means.

* * * * *